US007473002B1

(12) United States Patent
Chen

(10) Patent No.: US 7,473,002 B1
(45) Date of Patent: Jan. 6, 2009

(54) LAMP HAVING ROTATABLE PATTERNS

(76) Inventor: Yang-Chung Chen, 58, Ma Yuan West St., Taichung (TW)

( * ) Notice: Subject to any disclaimer, the term of this patent is extended or adjusted under 35 U.S.C. 154(b) by 0 days.

(21) Appl. No.: 11/890,456

(22) Filed: Aug. 7, 2007

(51) Int. Cl.
*F21V 21/30* (2006.01)
*G09F 13/00* (2006.01)

(52) U.S. Cl. ..... 362/35; 362/283; 40/433; 40/473

(58) Field of Classification Search ..... 362/25, 362/283, 284, 336, 811, 35; 40/430, 431.906, 40/473, 433; D26/24
See application file for complete search history.

(56) References Cited

U.S. PATENT DOCUMENTS 5,309,338 A * 5/1994 Liu ..... 362/253
6,584,713 B2 * 7/2003 Huang ..... 40/431
7,003,906 B1 * 2/2006 Yang ..... 43/430

* cited by examiner

*Primary Examiner*—John A Ward
(74) *Attorney, Agent, or Firm*—Alan Kamrath; Kamrath & Associates PA

(57) ABSTRACT

A lamp includes a base, a lamp socket fixedly mounted on the base, a rotation disk rotatably mounted on the base, a housing fixedly mounted on the rotation disk and having a plurality of patterns, and a plurality of light emitting members mounted on the lamp socket and hidden in the housing. Thus, the housing is rotatable relative to the light emitting members, and the patterns of the housing are rotatable and movable relative to the light emitting members, so that the light beams of the light emitting members are projected outwardly through the patterns of the housing to produce rotatable and movable images by rotation of the housing, thereby enhancing the aesthetic quality of the lamp.

19 Claims, 7 Drawing Sheets

LAMP HAVING ROTATABLE PATTERNS

BACKGROUND OF THE INVENTION

1. Field of the Invention

The present invention relates to a lamp and, more particularly, to a lamp such as a wall lamp, night lamp and the like.

2. Description of the Related Art

A conventional lamp comprises a base, a lamp socket mounted on the base, a light emitting member mounted on the lamp socket, and an outer shade mounted on the base to surround the light emitting member. Thus, the base is mounted on a wall (or ceiling) to attach the lamp onto the wall to provide a lighting effect. The outer shade of the lamp is provided with patterns to enhance the outer appearance of the lamp. However, the outer shade of the lamp has a fixed structure so that the patterns of the outer shade lack variation, thereby limiting the versatility of the lamp.

BRIEF SUMMARY OF THE INVENTION

In accordance with the present invention, there is provided a lamp, comprising a base, a lamp socket fixedly mounted on the base, a rotation disk rotatably mounted on the base and enclosed around the lamp socket, a housing fixedly mounted on the rotation disk to rotate with the rotation disk and having a surface formed with a plurality of patterns, and a plurality of light emitting members mounted on the lamp socket and fully hidden in the housing.

The primary objective of the present invention is to provide a lamp having rotatable patterns with variations.

Another objective of the present invention is to provide a lamp, wherein the housing is rotatable relative to the light emitting members, and the patterns of the housing are rotatable and movable relative to the light emitting members, so that the light beams of the light emitting members are projected outwardly through the patterns of the housing to produce rotatable and movable images by rotation of the housing, thereby enhancing the aesthetic quality of the lamp.

A further objective of the present invention is to provide a lamp, wherein the patterns of the housing have different shapes that vary according to the user's different requirements.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
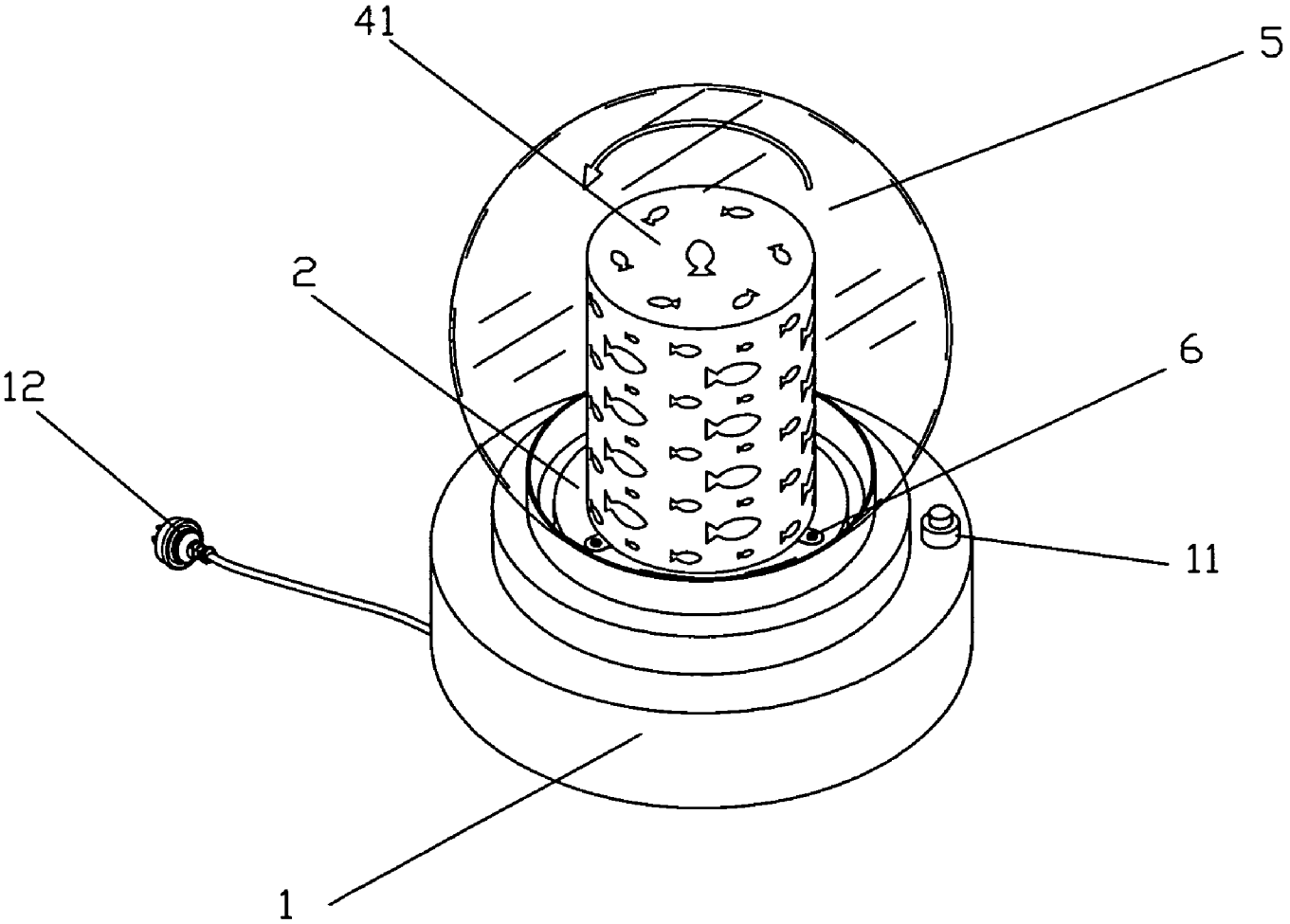
FIG. 1 is a perspective view of a lamp in accordance with the preferred embodiment of the present invention.
Figure 2:
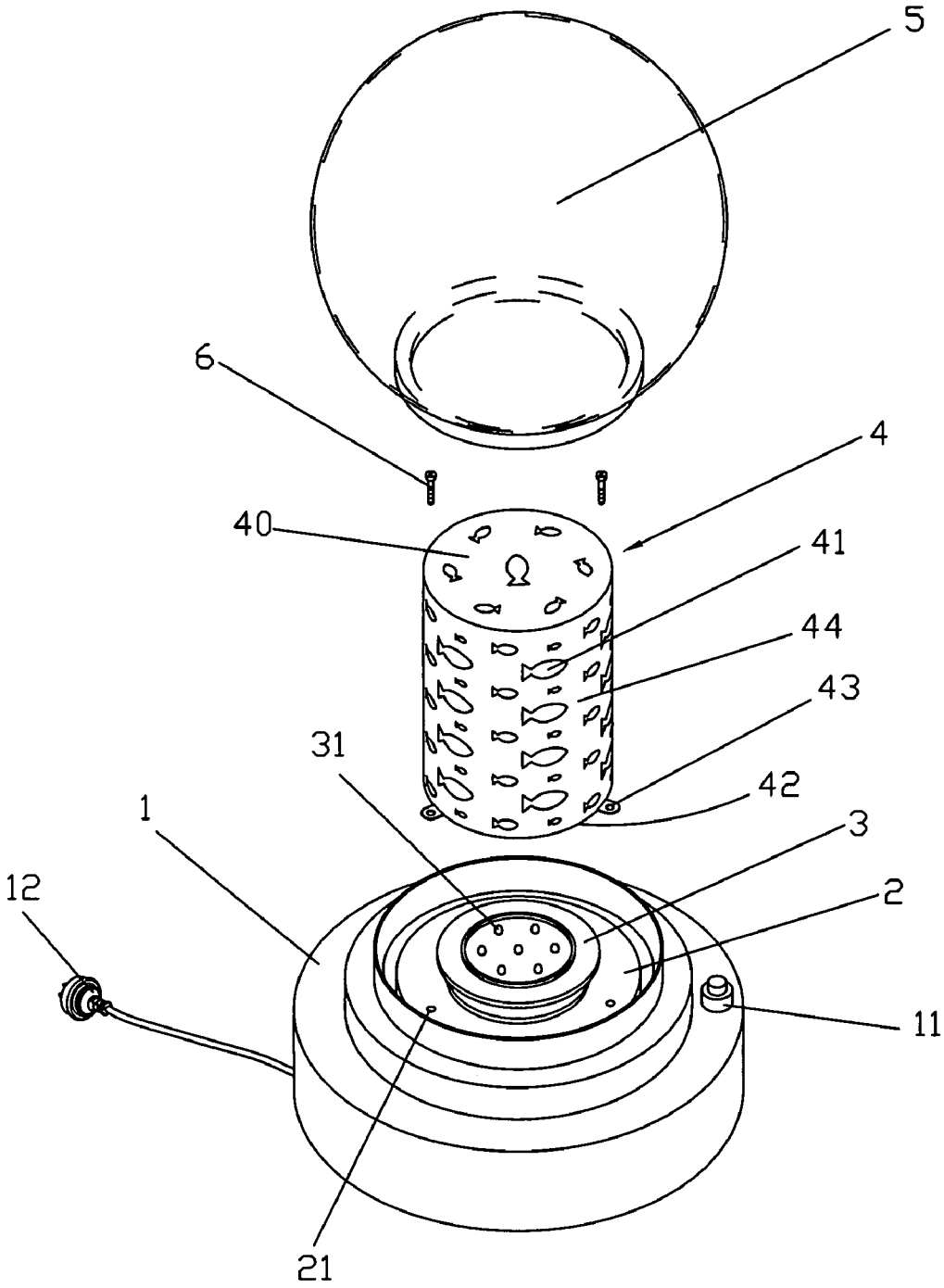
FIG. 2 is an exploded perspective view of the lamp as shown in FIG. 1.
Figure 3:
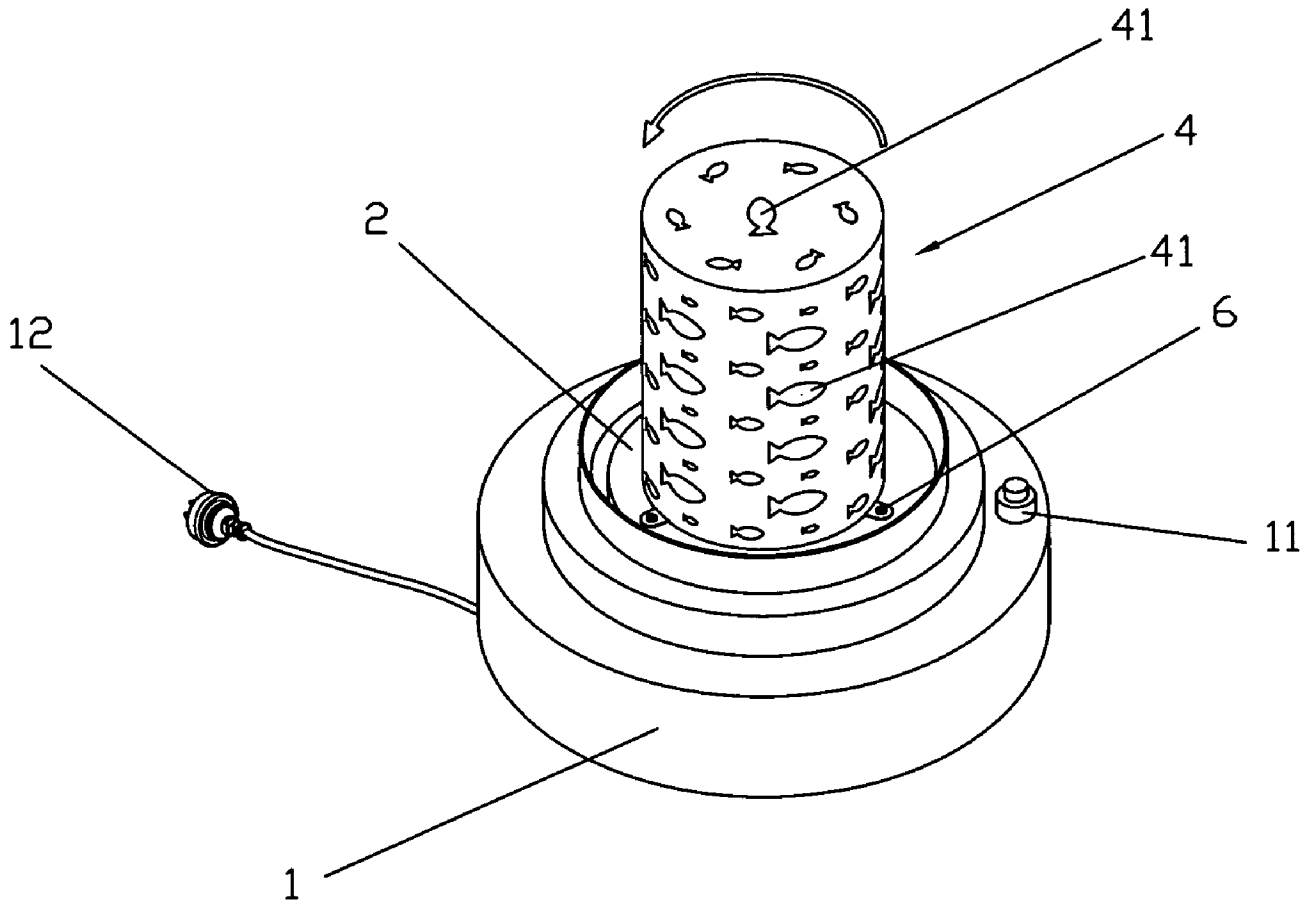
FIG. 3 is a partially perspective view of the lamp as shown in FIG. 1.
Figure 4:
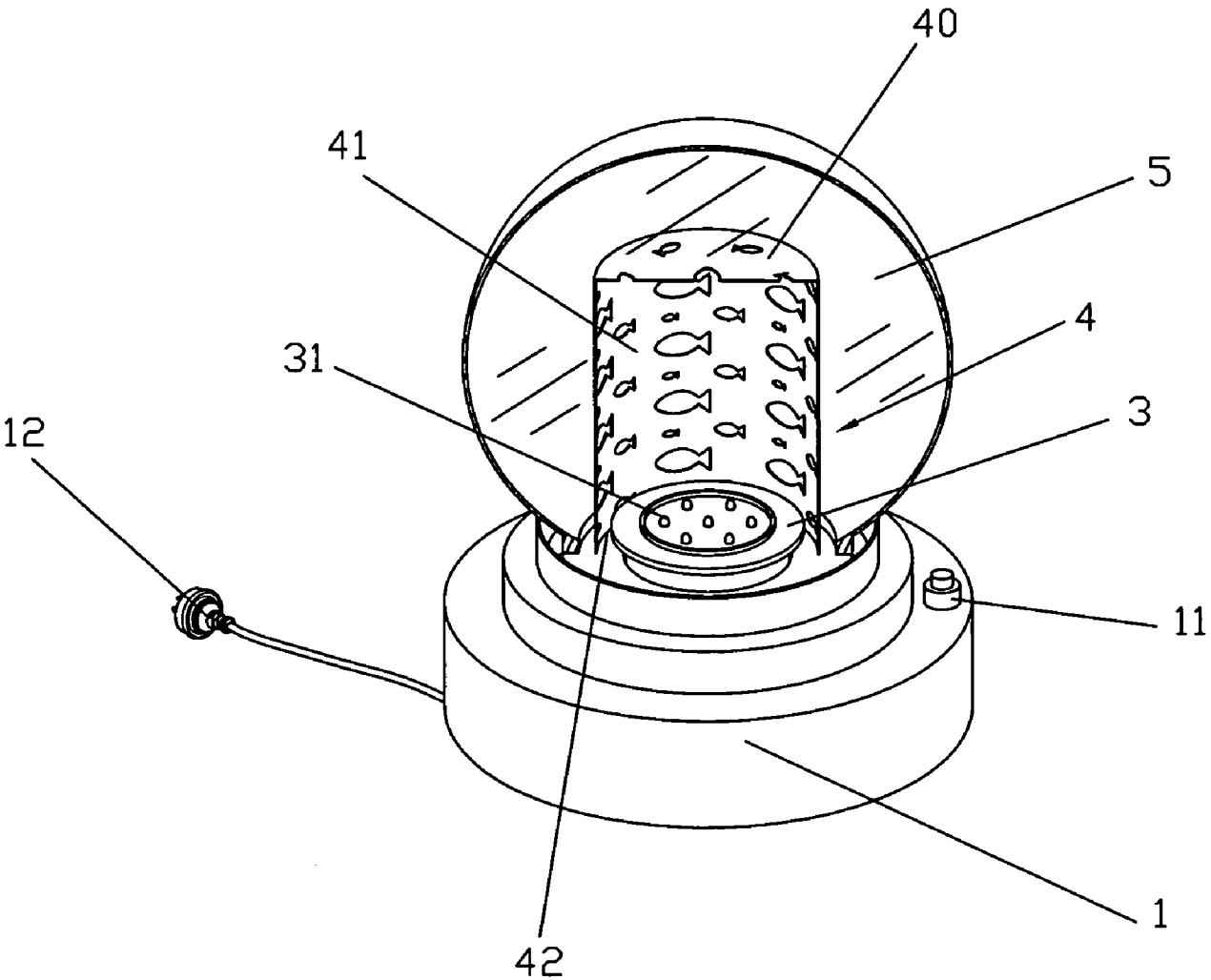
FIG. 4 is a partially cut-away perspective view of the lamp as shown in FIG. 1.

Referring to the drawings and initially to FIGS. 1-4, a lamp in accordance with the preferred embodiment of the present invention comprises a base 1, a lamp socket 3 fixedly mounted on the base 1, a rotation disk 2 rotatably mounted on the base 1 and enclosed around the lamp socket 3, a housing 4 fixedly mounted on the rotation disk 2 to rotate with the rotation disk 2 and having a surface formed with a plurality of patterns 41, a plurality of light emitting members 31 mounted on the lamp socket 3 and fully hidden in the housing 4, and an outer shade 5 mounted on the base 1 and enclosed around the housing 4 which is fully hidden in the outer shade 5.

The base 1 is provided with a power supply connector 12 electrically connected to a power supply (not shown) to supply an electric power to the light emitting members 31 and a push button 11 to control operation of the light emitting members 31.

The lamp socket 3 is located at a central portion of the base 1.

The rotation disk 2 is located at a periphery of the lamp socket 3. The rotation disk 2 has a hollow inside to surround the lamp socket 3. The rotation disk 2 has a peripheral wall formed with a plurality of threaded locking holes 21. The rotation disk 2 is rotatable relative to the lamp socket 3 and the light emitting members 31 so that the housing 4 is rotatable relative to the lamp socket 3 and the light emitting members 31.

Each of the light emitting members 31 emits light outwardly from the patterns 41 of the housing 4. In the preferred embodiment of the present invention, each of the light emitting members 31 is a light emitting diode, an electric bulb or a G5 light.

The housing 4 has a substantially cylindrical cross-sectional profile and has a closed top wall 40. The housing 4 has an open bottom wall 42 to allow passage of the lamp socket 3. The housing 4 has a periphery provided with a plurality of protruding locking pieces 43 each rested on the rotation disk 2 and each aligning with a respective locking hole 21 of the rotation disk 2, and the lamp further comprises a plurality of locking screws 6 each extended through a respective locking piece 43 of the housing 4 and each screwed into a respective locking hole 21 of the rotation disk 2 to lock the housing 4 onto the rotation disk 2. Each of the patterns 41 of the housing 4 is defined by a slot having the shape of a fish. The patterns 41 of the housing 4 are distributed on a peripheral wall 44 and the top wall 40 of the housing 4.

The outer shade 5 is made of a light permeable material.

Figure 5:
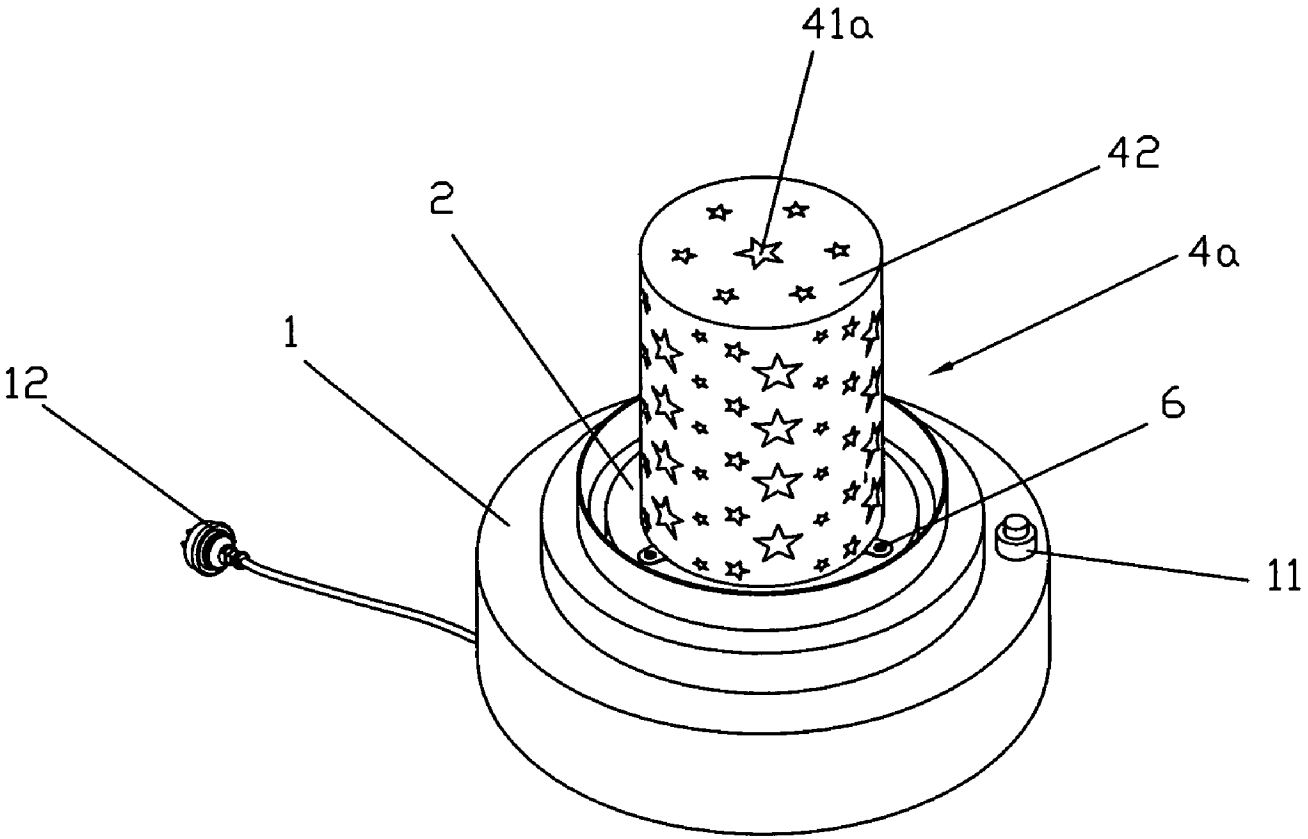
FIG. 5 is a partially perspective view of a lamp in accordance with another preferred embodiment of the present invention.

As shown in FIG. 5, each of the patterns 41*a* of the housing 4*a* is defined by a slot having the shape of a star.

Figure 6:
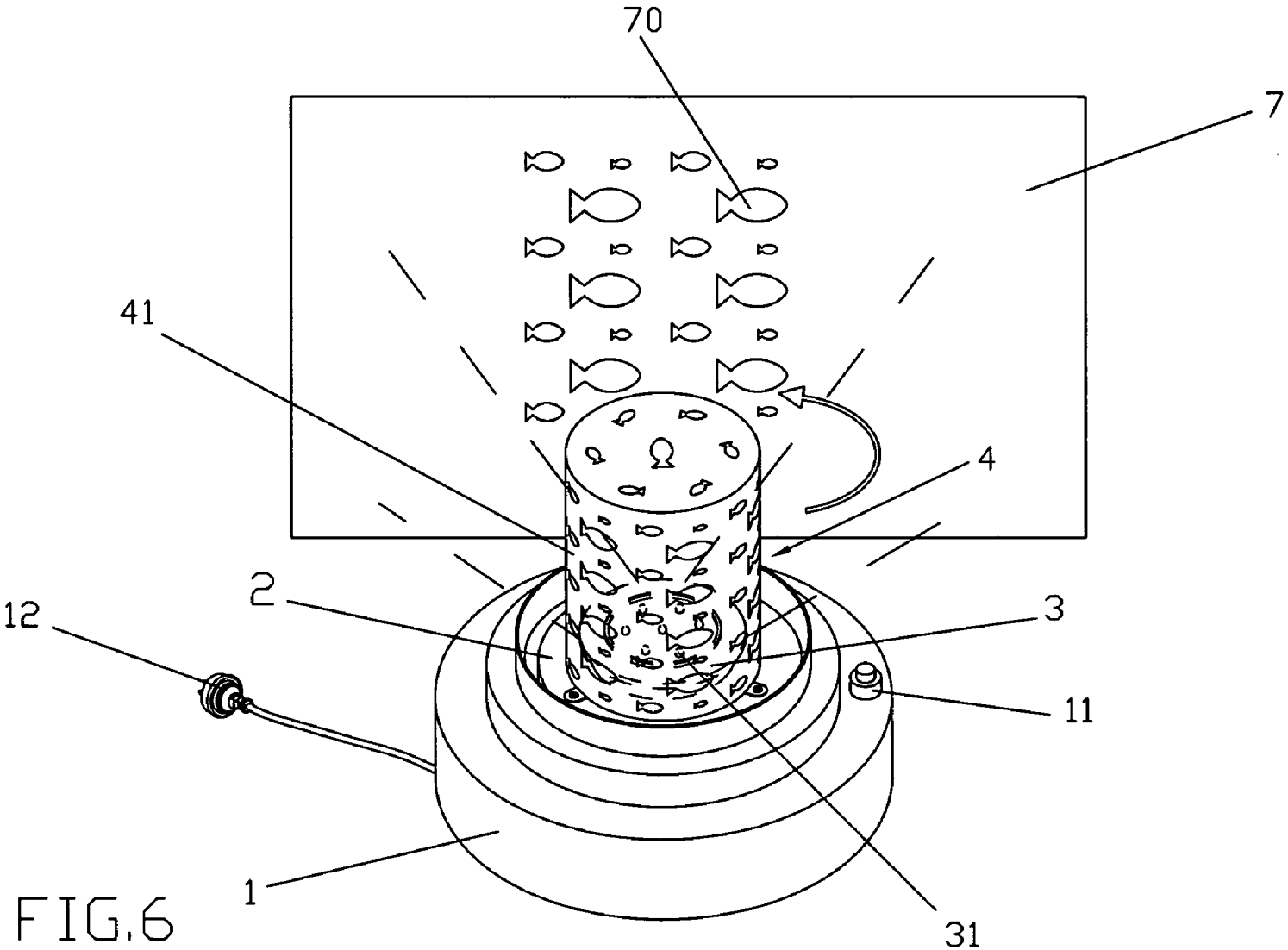
FIG. 6 is a schematic operational view of the lamp as shown in FIG. 1 in use.

As shown in FIG. 6, the light emitting members 31 emit light beams outwardly from the housing 4 to project the patterns 41 of the housing 4 onto an object, such as a ceiling or a wall 7. In such a manner, the patterns 41 of the housing 4 are projected onto the wall 7 by the light beams of the light emitting members 31 to form images 70 on the wall 7. At this time, the housing 4 is rotatable relative to the lamp socket 3 and the light emitting members 31 so that the patterns 41 of the housing 4 are movable relative to the lamp socket 3 and the light emitting members 31, and the images 70 are movable on the wall 7. Thus, the housing 4 is rotatable relative to the light emitting members 31, and the patterns 41 of the housing 4 are rotatable and movable relative to the light emitting members 31, so that the light beams of the light emitting members 31 will pass through the patterns 41 of the housing 4 to produce rotatable and movable images, thereby enhancing the aesthetic quality of the lamp.

Figure 7:
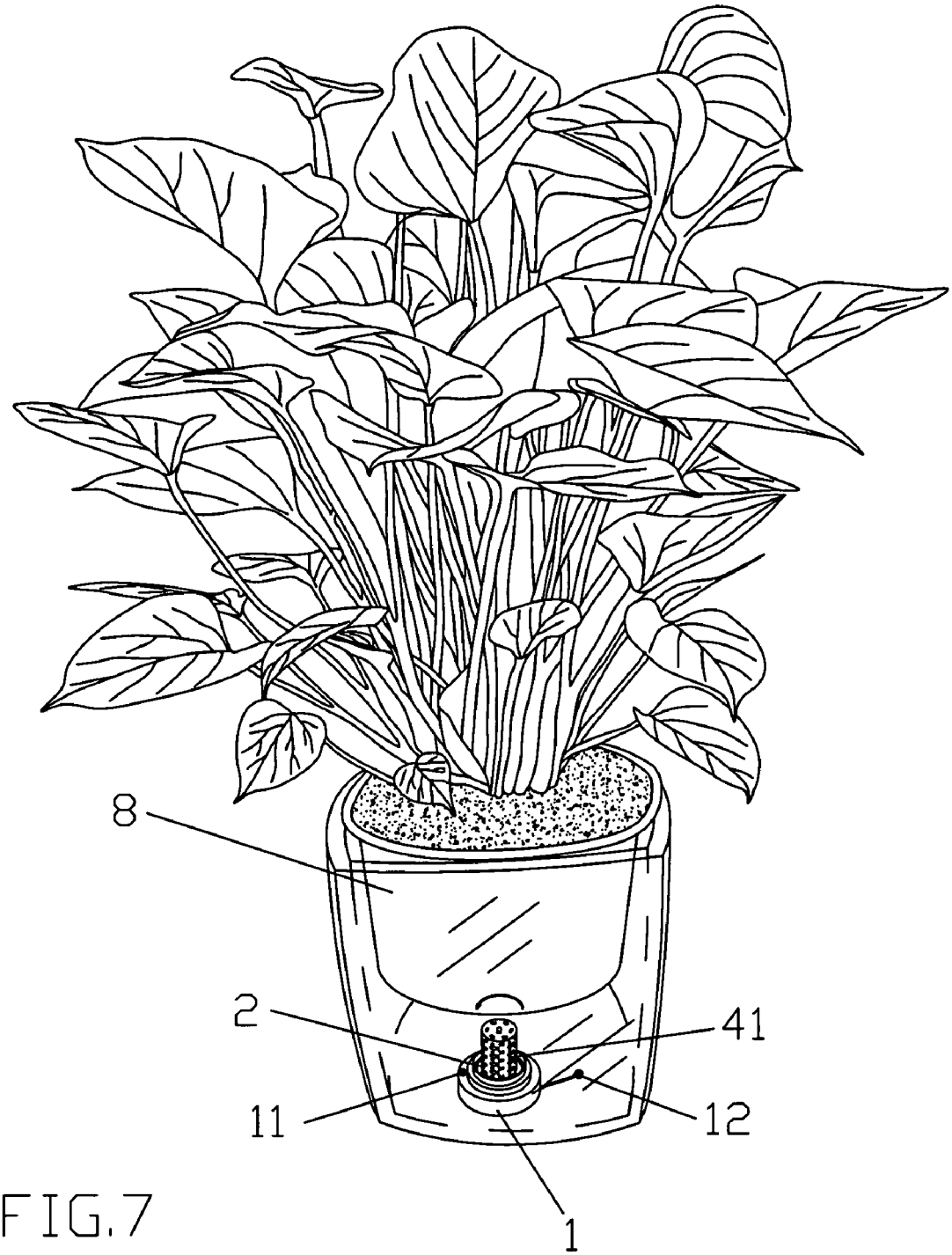
FIG. 7 is a schematic operational view of the lamp as shown in FIG. 1 in use.

As shown in FIG. 7, the lamp is mounted in an object, such as a transparent vase 8 to enhance the aesthetic quality of the vase 8.

Accordingly, the housing 4 is rotatable relative to the light emitting members 31, and the patterns 41 of the housing 4 are rotatable and movable relative to the light emitting members 31, so that the light beams of the light emitting members 31 are projected outwardly through the patterns 41 of the housing 4 to produce rotatable and movable images by rotation of the housing 4, thereby enhancing the aesthetic quality of the lamp. In addition, the patterns 41 of the housing 4 have different shapes that vary according to the user's different requirements.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lamp, comprising:

a base;

a lamp socket fixedly mounted on the base;

a rotation disk rotatably mounted on the base and enclosed around the lamp socket;

a housing fixedly mounted on the rotation disk to rotate with the rotation disk and having a surface formed with a plurality of patterns;

a plurality of light emitting members mounted on the lamp socket and fully hidden in the housing; wherein the rotation disk has a peripheral wall formed with a plurality of threaded locking holes;

the housing has a periphery provided with a plurality of radially and outwardly protruding locking pieces each rested on the rotation disk and each aligning with a respective locking hole of the rotation disk;

the lamp further comprises a plurality of locking screws each extended through a respective locking piece of the housing and each screwed into a respective locking hole of the rotation disk to lock the housing onto the rotation disk.

2. The lamp in accordance with claim 1, wherein the lamp socket is located at a central portion of the base.

3. The lamp in accordance with claim 1, wherein the rotation disk has an annular stepped shape and is located at a periphery of the lamp socket.

4. The lamp in accordance with claim 1, wherein the rotation disk has a hollow inside to surround the lamp socket.

5. The lamp in accordance with claim 1, wherein the rotation disk is rotatable relative to the lamp socket and the light emitting members;

the housing is rotatable relative to the lamp socket and the light emitting members.

6. The lamp in accordance with claim 5, wherein the patterns of the housing are rotatable and movable relative to the lamp socket and the light emitting members.

7. The lamp in accordance with claim 1, wherein each of the light emitting members emits light outwardly from the patterns of the housing.

8. The lamp in accordance with claim 1, wherein the housing has a substantially cylindrical cross-sectional profile and has a constant diameter.

9. The lamp in accordance with claim 1, wherein each of the patterns of the housing is defined by a slot, and the slots of the patterns of the housing have different shapes.

10. The lamp in accordance with claim 1, wherein the housing has an open bottom wall to allow passage of the lamp socket.

11. The lamp in accordance with claim 1, wherein the housing has a closed top wall which connects a peripheral wall of the housing.

12. The lamp in accordance with claim 11, wherein the patterns of the housing are distributed on the peripheral wall and the top wall of the housing.

13. The lamp in accordance with claim 1, further comprising a spherical outer shade mounted on the base and enclosed around the housing.

14. The lamp in accordance with claim 13, wherein the housing is fully hidden in the outer shade, and the outer shade has a smooth outer surface.

15. The lamp in accordance with claim 13, wherein the outer shade is made of a light permeable material.

16. The lamp in accordance with claim 1, wherein the light emitting members emit light beams outwardly from the housing to project the patterns of the housing onto an object.

17. The lamp in accordance with claim 1, wherein the lamp is mounted in an object.

18. The lamp in accordance with claim 1, wherein the patterns of the housing have different shapes.

19. The lamp in accordance with claim 1, wherein the base is provided with a power supply connector to supply an electric power to the light emitting members and a push button to control operation of the light emitting members.

* * * * *